United States Patent [19]

Slawinski et al.

[11] Patent Number: 4,764,231

[45] Date of Patent: Aug. 16, 1988

[54] WELL STIMULATION PROCESS AND LOW VELOCITY EXPLOSIVE FORMULATION

[75] Inventors: Frank E. Slawinski, Carl Junction, Mo.; William L. Frantz, New Ringgold, Pa.

[73] Assignee: Atlas Powder Company, Dallas, Tex.

[21] Appl. No.: 97,530

[22] Filed: Sep. 16, 1987

[51] Int. Cl.[4] ..... C06B 25/14

[52] U.S. Cl. ..... 149/104; 149/11; 149/88; 149/101; 149/109.6; 102/301; 102/313

[58] Field of Search ..... 149/11, 88, 101, 104, 149/109.6; 102/301, 313

[56] References Cited

U.S. PATENT DOCUMENTS

| | | | |
|---|---|---|---|
| 3,116,188 | 12/1963 | Austin | 149/88 |
| 4,092,187 | 5/1978 | Hildebrant et al. | 149/11 |
| 4,106,960 | 8/1978 | Brachert et al. | 149/11 |
| 4,163,681 | 8/1979 | Rothenstein et al. | 149/113 |
| 4,292,098 | 9/1981 | Mastroianni et al. | 149/89 |
| 4,490,196 | 12/1984 | Funk | 149/92 |
| 4,555,279 | 11/1985 | Funk | 149/92 |
| 4,595,430 | 6/1986 | Baker | 149/88 |

OTHER PUBLICATIONS

Uren, Petroleum Production Engineering-Oil Field Development, 3rd Edition, 1952 McGraw Hill, "Use of Explosives in Well Completion," pp. 588–593.

Uren, Petroleum Production Engineering-Oil Field Exploitation, 3rd Edition, 1953 McGraw Hill, pp. 165 and 419–424.

*Primary Examiner*—Stephen J. Lechert, Jr.

*Attorney, Agent, or Firm*—Richards, Harris, Medlock & Andrews

[57] ABSTRACT

Well stimulation involving use of a liquid explosive composition in the explosive fracturing of subterranean formations such as oil and gas bearing formations. An explosive formulation comprising a nitrate ester explosive component and a phlegmatizer component is introduced into a well penetrating the formation to be fractured. The phlegmatizer component is an alkyl or alkoxy diester which is mixable with the nitrate ester and can be varied in concentration to control the detonation velocity and maximum explosive pressure. Examples of phlegmatizing agents include alkyl or alkoxy alkyl esters of adipate or azelaic acids such as dibutoxy adipate or diisobutyl azelate or polyethylene glycoxy-based diesters such as triethylene glycol dipelargonate. After the formulation is detonated to fracture the formation, the well is placed on production to recover hydrocarbons at an increased rate.

35 Claims, 1 Drawing Sheet

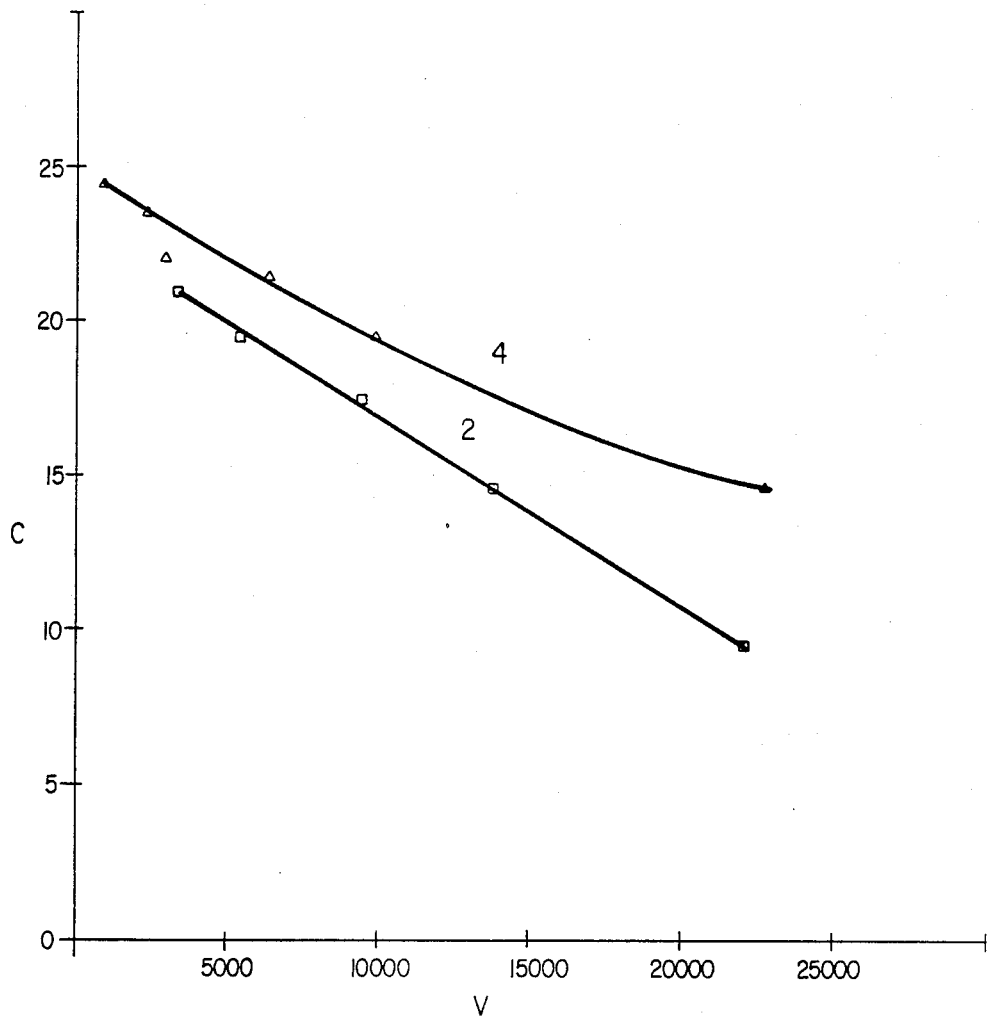
25
20
15
10
5
0
C
4
2
5000
10000
15000
20000
25000
V

WELL STIMULATION PROCESS AND LOW VELOCITY EXPLOSIVE FORMULATION

TECHNICAL FIELD

This invention relates to the explosive fracturing of subterranean formations and, more particularly, to the explosive stimulation of wells penetrating subterranean hydrocarbon bearing formations and formulations useful in such processes.

ART BACKGROUND

In the petroleum industry it is a well known practice in the completion of new wells and the workover of existing wells to employ explosives to stimulate the flow of oil and/or gas from hydrocarbon bearing formations. Various types of explosive formulations have been used in such procedures. Historically, explosives used in well stimulation have taken the form of high energy explosives of high detonation velocities. Uren, L. C. "Petroleum Production Engineering-Oil Field Development," 3rd Edition, 1952 McGraw Hill, under the heading "Use of Explosives in Well Completion", pages 588–593, discloses use of explosives such as dynamite, nitroglycol or nitroglycerin having detonation velocities in excess of 20,000 feet per second. The use of such explosives is also disclosed in the companion volume by Uren, "Petroleum Production Engineering-Oil Field Exploitation", 3rd Edition, 1953, at pages 165 and 419–424. Emphasis is placed not only on fracturing the surrounding subterranean formation, but also on forming cavities in the well to enlarge the effective diameter of the well at the formation face.

A somewhat different approach in explosive well stimulation involves the use of explosives of relatively low detonation velocity as disclosed in U.S. Pat. No. 4,490,196 to Funk. The compositions in Funk are formulated from a first explosive component mixture, specifically, a 40-60/60-40 mixture of metriol trinitrate and diethylene glycol dinitrate; a second component (termed an ester component although not all of the second component compounds are esters) taking the form of an aromatic diester, a trialkylaryl phosphate such as tricresyl phosphate, or a mono or polyacetyl alkane; and an organic stabilizer component such as ethyl centralite. The explosive formulations disclosed in Funk are said to have slow detonation velocities within the range of about 1200–2500 meters/second. The low detonation velocity explosive formulations exhibit a small shockwave component in relation to the total explosive energy and provide a maximum pressure less than the yield stress of the rock formation surrounding the wellbore in which the charge is detonated. This minimizes formation of a residual stress field due to plastic deformation of the rock and minimizes direct borehole damage at the rock face. U.S. Pat. No. 4,555,279 to Funk is a continuation in part of Funk '196 and discloses an alkylaryl dinitrate as an alternative to the ester components of Funk '196. The explosive component may be metriol trinitrate, diethylene glycol dinitrate, or nitroglycerine.

Whereas the patents to Funk disclose the use of diesters of polybasic aromatic acids to arrive at explosive formulations of reduced detonation velocity, U.S. Pat. No. 4,595,430 to Baker discloses the use of diesters in which the acid component does not contain a benzyl group to desensitize a dynamite composition to impact detonation while only minimally reducing explosive characteristics such as velocity or rate of detonation velocity buildup. The diester desensitizer of U.S. Pat. No. 4,595,430 is employed in the dynamite in relative small amounts; in a range of 0.5–5.0 wt. % preferably 1.5 to 2.5 wt. %. The desensitizers disclosed there include diesters of dibasic acids having from 5 to 12 carbon atoms, including diesters of glutaric, adipic, and sebacic acids. Triesters or polyesters, exclusive of those containing benzene rings can also be employed as desensitizers. Preferred desensitizers include triethylene glycol caprate caprylate, mixed diesters produced by reacting isodecyl and 2-ethyl hexanol with a mixture of $C_4$–$C_9$ dicarboxyalic acids and triethylene glycol dipelargonate, glyceryl triacetate or glyceryl triproprionate.

U.S. Pat. No. 3,116,188 to Austin discloses the use of surface active agents to desensitize liquid explosives such as ethylene glycol dinitrate and nitroglycerine to impact detonation. Included as desensitizers are polyesters of polybasic aliphatic acids in which the esterifying portion contains from 3 to 7 carbon atoms. Specifically disclosed are tributyrin, tricaproin, and di-n-butyl sebacate used in amounts of 10–30%.

U.S. Pat. No. 4,292,098 to Mastroianni et al discloses liquid gun propellants based upon liquid nitrate esters or nitroparaffins containing a diluent or desensitizing agent in the form of a diester of $C_7$–$C_9$ dicarboxylic acids and $C_3$–$C_5$ alcohols. The preferred esters are azelates with isopropyl or isobutyl ester groups. The desensitizing ester is present in an amount within the range of 5–25 wt. %. A stabilizer such as 2-nitrodiphenylamine, resorcinol or ethyl centralite may also be employed in an amount of 1–4%.

DESCRIPTION OF THE INVENTION

In accordance with the present invention, there is provided a new and advantageous well stimulation process employing a liquid explosive composition in the explosive fracturing of subterranean formations. The explosive composition comprises a nitrate ester explosive component selected from the group consisting of nitroglycerine, ethylene glycol dinitrate, propylene glycol dinitrate, diethylene glycol dinitrate and trimethylolethane trinitrate and mixtures thereof in combination with a phlegmatizer component which is soluble in the explosive component. The phlegmatizer component is at least one compound having the formula:

$$R_2-O-\overset{\overset{\displaystyle O}{\|}}{C}-R_1-\overset{\overset{\displaystyle O}{\|}}{C}-O-R_3 \qquad (1)$$

or $$R_5-\overset{\overset{\displaystyle O}{\|}}{C}-O-R_4-O-\overset{\overset{\displaystyle O}{\|}}{C}-R_6 \qquad (2)$$

wherein:

$R_1$ is a $C_4$–$C_9$ alkyl group, $R_2$ and $R_3$ are each independently alkyl or alkoxyalkyl groups containing from 3–11 carbon atoms, $R_4$ is an alkyl or alkoxy group, preferably ethyleneglycoxy or polyethyleneglycoxy, containing from 2–6 carbon atoms, and $R_5$ and $R_6$ are each independently alkyl or alkoxyalkyl groups containing from 3–11 carbon atoms.

Preferably, the explosive formulation also contains a stabilizer such as ethyl centralite in an amount ranging up to about 1–2%. The explosive component may be present in an amount of about 65% or more with the remainder being the phlegmatizer and the stabilizer, if any. The phlegmatizer concentration may be varied in order to arrive at the desired velocity of detonation and peak detonation pressure. The explosive formulation can be formulated with excellent low temperature flowability characteristics. Preferably, it has a viscosity at minus 20° F. of no more than 500 centipoise (cp).

The phlegmatized explosive composition, as described, above is introduced into a well in proximity to the subterranean formation and then detonated to explosively fracture the subterranean formation. The stimulation process is particularly applicable to the explosive fracturing of oil and/or gas-bearing formations. The phlegmatizer concentration desirably is adjusted in the composition to produce a product having a sufficiently low velocity of detonation and maximum detonation pressure which is greater than the yield strength of the formation but less than the compressive strength. At the same time, the flame front imparts sufficient heat to reduce the waxy and asphalt deposits in the formation, thus facilitating a clean-up of the formation matrix material as well as the inducement of fractures.

BRIEF DESCRIPTION OF THE DRAWING

The drawing is a graph illustrating the relationship between the velocity of detonation and phlegmatizer concentration for explosive formulations embodying the present invention.

DETAILED DESCRIPTION

The present invention involves explosive formulations and their use in well stimulation in which the detonation velocity and pressure can be closely regulated, thus enabling the formulation to be matched in its explosive characteristics to the formation surrounding the wellbore to minimize spalling of the wellbore wall while enhancing fracture formation. The formulations used in the present invention comprises a liquid nitrate explosive component, a phlegmatizing component which is miscible with and stable in the explosive component and optionally a stabilizer component. The explosive component normally will be present in the formulation in an amount of at least 65 wt. % the phlegmatizer component in an amount within the range of 5–30 wt. % and preferably about 7–25 wt. %, and the stabilizer component in an amount within the range of 0–5 wt. % preferably about 0.1 to 3 wt. %.

Liquid nitrate esters useful as the explosive component in the present invention include nitroglycerin (abbreviated NG) ethylene glycol dinitrate (EGDN), propylene glycol dinitrate (PGDN) diethylene glycol dinitrate (DEGDN) and trimethylolethane trinitrate (TMETN). These materials can be employed in the explosive formulation alone or in a mixture with other nitrate esters. Where the explosive component has only a single constituent, i.e. is not a mixture, it preferably will take the form of EGDN or PGDN. Preferred mixtures are mixtures of EGDN and nitroglycerine, DEGDN and NG, and TMETN and NG. In such mixtures, it usually will be preferred that the EGDN, DEGDN, or TMETN be present in an amount of at least 50 wt. %. Usually, the NG will be present as a minor constituent, e.g. less than 50% and the EGDN, DEGDN or TMETN is a major constituent, i.e. greater than 50% of the explosive mixture. Typical weight ratios of EGDN, DEGDN or TMETN to NG are 1.5:1 to 2:1.

The phlegmatizing agents employed in the present invention may be characterized generally as esters of dibasic acids, specifically $C_6$–$C_{11}$ organic acids which meet certain criteria of nitrate ester miscibility, stability and cold temperature flowability. Certain of the phlegmatizing compounds for dynamite disclosed in the aforementioned U.S. Pat. No. 4,595,430 can be used as phlegmatizing agents in the liquid formulations of the present invention. However, in contrast to the teachings in this patent respecting the use of such compounds to produce impact insensitivity without having a significant effect upon detonation velocity or other detonation properties, the phlegmatizing agents of the present invention are used to drastically curtail the detonation velocity of the explosive formulation. In addition, as indicated by the experimental data presented hereinafter, by varying the concentration of the phlegmatizing agent in the present invention the detonation pressure velocity and maximum explosive pressure can be closely controlled. This enables the explosive formulation to be fine tuned to meet the requirements of a given well.

The preferred phlegmatizing agents employed in the present invention are selected from the class of alkyl or alkyoxyalkyl diesters of dicarboxylic acids, most preferably of adipic, pimelic, suberic or azelaic acids. Such esters may be characterized by the following general formula:

$$R_2-O-\overset{\overset{\displaystyle O}{\|}}{C}-R_1-\overset{\overset{\displaystyle O}{\|}}{C}-O-R_3 \qquad (1)$$

wherein:

$R_1$ is a $C_4$–$C_9$ alkyl group, and $R_2$ and $R_3$ are each independently alkyl or alkoxyalkyl groups containing from 3–11 carbon atoms.

A particularly preferred class of esters are dialkoxylalkyl esters which may be characterized by the following general formula:

$$R_9-O-R_7-O-\overset{\overset{\displaystyle O}{\|}}{C}-R_1-\overset{\overset{\displaystyle O}{\|}}{C}-O-R_8-O-R_{10} \qquad (3)$$

wherein:

$R_1$ is $C_4$–$C_9$ alkyl group, $R_7$ and $R_8$ are each independently a $-C_2H_4-$ or $-C_3H_6-$ group, and $R_9$ and $R_{10}$ are each independently alkyl groups containing from 1–6 carbon atoms.

Examples of suitable phlegmatizing agents are alkyl or alkoxy adipates. Suitable diesters include dialkoxyethyl or -propyl esters of adipic acid such as dimethoxypropyl adipate, diethoxypropyl adipate, dipropoxypropyl adipate, dibutoxypropyl adipate, dimethoxyethyl adipate, diethoxyethyl adipate, dipropoxyethyl adipate and dibutoxyethyl adipate. The latter, abbreviated DBEA, is a particularly preferred phlegmatizing agent for use in the invention.

Mixed dialkoxyalkyl adipates may also be employed as phlegmatizing agents in accordance with the invention. An example is dialkoxyalkyl, adipate (abbreviated DAADA) which is a mixture of $C_4$–$C_7$ dialkyoxyalkyl adipates produced by esterifying adipic acid with a mixture of $C_4$–$C_7$ alkyoxyalkanols. A typical average molecular weight of DDADA is about 360 corresponding to an average carbon number of $R^2$ and $R^3$ in formula (1) of about 6.5. Another mixed adipic acid diester suitable for use in the present invention is produced by esterifying a mixture of $C_5$–$C_9$ alkoxyalkanols with adipic acid to produce a product having an average molecular weight of about 500. Another example of mixed diesters useful in the invention is alkyl, alkylether diester adipate (abbreviated AAEDA) which is a mixture of diesters containing both alkoxy and alkyl groups.

Further examples of phlegmatizing agents suitable for use in the present invention are the diesters of azelaic acid. Diesters within this group include dipropyl and dibutyl azelates. The alkyl groups may be either normal- or iso-alkyls and a particularly preferred azelaic acid diester is diisobutyl azelate (abbreviated DIBZ).

Additional phlegmatizing agents useful in the present invention, but less preferred than the compounds of formula (1), include diesters characterized by the formula:

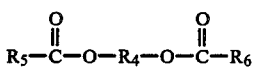

(2)

wherein:

$R_4$ is an alkyl or alkoxy group containing from 2–6 carbon atoms, and $R_5$ and $R_6$ are each independently alkyl or alkoxyalkyl groups containing from 3–11 carbon atoms.

Preferably, in compounds generally characterized by formula (2), $R_4$ is an ethyleneglycoxy and more preferably a polyethyleneglycoxy group. A preferred phlegmatizing agent within this group of compounds is triethylene glycol dipelargonate.

As noted previously, the phlegmatizer used is in an amount within the range of 5–30 wt. %. The detonation velocity of the explosive formulation is progressively decreased with increasing amounts of phlegmatizing agents. While the amount to be used will depend upon the particular explosive component and the desired detonation characteristics, usually it will be preferred to use at least 10%, and preferably at least 15 wt. % phlegmatizing agent.

As noted previously, the liquid explosive formulation of the present invention may, and preferably will, include a small quantity of a stabilizer. The stabilizer functions to retard the decomposition of the nitrate ester into oxides of nitrogen, and in addition to scavenge such oxides if they should be formed.

Suitable stabilizers include ethyl centralite (diethyldiphenylurea), methyl centralite, 2 nitro diphenylamine, sodium carbonate, methyl nitroanaline, and methyldiphanylurea. The stabilizer may be employed in amounts up to about 5 wt. % of the explosive formulation, although somewhat lesser amounts, within the range of 0.1–3 wt. %, will normally be used. In most cases, the stabilizer can be used in amounts less than 1 wt. %. In some cases, it may be dispensed with, especially where the explosive formulation is to be used shortly after its preparation.

As noted previously, the detonation pressure of the explosive formulation should be greater than the yield strength of the formation surrounding the wellbore. This value will vary depending upon the overburden pressure on the formation (which in general increases with depth), the horizontal stress characteristics on the formation and the strength of the formation. By way of example, the yield strength of a 20'–30' thick sandstone at a depth of 1,000' typically will be about 1000 psi. The same formation at a depth of 3,000' will exhibit a yield strength of about 2000 psi. Corresponding limestone formations at these depths will usually exhibit somewhat higher yield strengths; about 1500 psi at 1,000 feet and 2500 psi at 3,000 feet. The foregoing yield strengths are exemplary only and depending upon the rock characteristics may vary by increments of ±500 psi or more from the above figures. The compressive strengths of such rock formations are, of course, much greater than the yield strengths. Typically, the compressive strength will be at least an order of magnitude greater than the yield strength, usually more.

The detonation pressure immediately behind the detonation front may be defined generally as a function of the velocity of detonation and the density of the explosive in accordance with the following relationship:

$$DP = 2.325 \times 10^{-7} V^2 p$$

wherein:

DP equals the detonation pressure in Kbars, p equals the density in grams per cubic centimeter, and V equals the velocity of detonation in feet per second (fps).

Measured detonation velocities and calculated detonation pressures for various explosive formulations, including some which do not fall within the scope of the present invention, are set forth in Table I.

TABLE I

| TEST NO. | NITRATE ESTER | RATIO BY WEIGHT | WEIGHT % | PHLEG-MATIZER | WT % | WT % STABILIZER | DETONATION VELOCITY FPS | DETONATION PRESSURE KBARS |
|---|---|---|---|---|---|---|---|---|
| 1 | EGDN-NG | 4:1 | 50 | DNT | 50 | — | 3,470 | 3.7 |
| 2 | EGDN-NG | 4:1 | 60 | DNT | 40 | — | 5,080 | 7.9 |
| 3 | EGDN-NG | 2:1 | 85 | DBEA | 15 | — | 20,835 | 133.2 |
| 4 | EGDN-NG | 2:1 | 80 | DBEA | 20 | — | 5,210 | 8.3 |
| 5 | EGDN-NG | 2:1 | 85 | Triacetin | 15 | — | 23,150 | 164.5 |
| 6 | EGDN-NG | 2:1 | 80 | Triacetin | 20 | — | 5,955 | 35.5 |
| 7 | DEGDN | — | 99.5 | — | — | 0.5 | 4,630 | 6.6 |
| 8 | DEGDN/NG | 3:2 | 90 | DBEA | 9.5 | 0.5 | 22,220 | 151.5 |
| 9 | DEGDN/NG | 3:2 | 85 | DBEA | 14.5 | 0.5 | 13,890 | 59.2 |
| 10 | DEGDN/NG | 3:2 | 82 | DBEA | 17.5 | 0.5 | 9,500 | 27.7 |
| 11 | DEGDN/NG | 3:2 | 80 | DBEA | 19.5 | 0.5 | 5,400 | 8.9 |
| 12 | DEGDN/NG | 3:2 | 78.5 | DBEA | 21.0 | 0.5 | 3,400 | 3.5 |
| 13 | EGDN | | 85.0 | DBEA | 14.5 | 0.5 | 22,990 | 160.9 |
| 14 | EGDN | | 80.0 | DBEA | 19.5 | 0.5 | 9,800 | 29.5 |
| 15 | EGDN | | 78.0 | DBEA | 21.5 | 0.5 | 6,350 | 12.4 |
| 16 | EGDN | | 77.5 | DBEA | 22.0 | O.5 | 2,910 | 2.6 |
| 17 | EGDN | | 76.0 | DBEA | 23.5 | O.5 | 2,310 | 1.6 |

TABLE I-continued

| TEST NO. | NITRATE ESTER | RATIO BY WEIGHT | WEIGHT % | PHLEG-MATIZER | WT % | WT % STABILIZER | DETONATION VELOCITY FPS | DETONATION PRESSURE KBARS |
|---|---|---|---|---|---|---|---|---|
| 18 | EGDN | | 75.0 | DBEA | 24.5 | 0.5 | 835 | 0.2 |
| 19 | EGDN | | 75.0 | DBP | 24.5 | 0.5 | 4,000 | 4.9 |
| 20 | EGDN | | 75.0 | TEGDP | 24.5 | 0.5 | 4,000 | 4.9 |
| 21 | EGDN | | 75.0 | TA | 24.5 | 0.5 | 4,000 | 4.9 |
| 22 | TMETN-DEGDN | 1:1 | 84.5 | TA | 15.0 | 0.5 | 5,000 | 7.7 |
| 23 | TMETN-NG | 3:2 | 82 | DBEA | 17.5 | 0.5 | 9,000 | 24.8 |
| 24 | TMETN-NG | 3:2 | 78.5 | DBEA | 21.0 | 0.5 | 1,000 | 0.3 |
| 25 | EGDN | | 78.0 | DIBZ | 21.5 | 0.5 | 5,012 | 7.7 |
| 26 | EGDN | | 78.0 | AAEDA | 21.5 | 0.5 | 6,290 | 12.1 |

In Table I, the nitrate ester component of the explosive formulation is characterized in the first three columns in terms of the explosive constituents (employing the abbreviations given previously), the relative weight proportions of the explosive constituents where mixtures are formed, e.g., for formulation #1, the explosive component is four parts EGDN and one part NG, and the wt. % of the explosive components as a percent of the total explosive formulation. The fourth column identifies the phlegmatizer (also by abbreviations), and the fifth gives the amount of phlegmatizer expressed as a wt. % of the total formulation. Stabilizer concentration is given in the sixth column. In each case, the stabilizer employed was ethyl centralite. The last two columns give the detonation velocity in feet per second, and the calculated detonation pressure in Kbars.

The results of certain of the experimental work presented in Table I are presented graphically in FIG. 1. In FIG. 1, curves 2 and 4 are graphs of the detonation velocity, V, in feet per second on the abscissa plotted as a function of the phlegmatizer concentration, C, in wt. % on the ordinate. Curve 2 is a graph of the detonation velocity observed for Tests 8–12 employing a mixture of three parts diethylene glycol dinitrate and two parts nitro glycerine. Curve 4 is a graph of Tests 13–18 for formulation in which the explosive component was ethyl glycol dinitrate. In each case for all the data points presented in curves 2 and 4, the phlegmatizer component was dibutoxyethyl adipate.

As can be seen by an examination of curves 2 and 4, the detonation velocity and pressure can be substantially reduced by the use of the phlegmatizing agent. The detonation velocity is decreased nearly linearly and predictably by increasing the phlegmatizing agent concentration.

Certain of the test runs carried out using 100% EGDN as the explosive component indicate the activities of preferred phlegmatizers dibutoxyethyl adipate (DBEA), diisobutyl azelate (DIBZ), alkyl, and dialkoxyalkyl diester adipate (DAADA) at high concentrations in the same explosive. Thus, formulations 15, 25 and 26 in each case contained 21.5% of DBEA, DIBZ and DAADA, respectively. Runs 16–18 show the activities for 22–24.5% DBEA in EGDN formulations.

Aylkoxy based esters as exemplified by triethylene glycol dipelargonate are somewhat less effective than the preferred diesters of the dibasic $C_6$–$C_9$ acids as described above. However, even these diesters are at least as effective as the aromatic based phlegmatizing agents disclosed in the aforementioned patents to Funk or the polyacetoxy agents (triacetin) disclosed in Funk. In this respect, runs 19, 20 and 21 in Table I were carried out with a formulation in which the explosive component was 100% EGDN and the phlegmatizing agent present in a concentration of 24.5 wt. %. Runs 19 and 21 were carried out with dibutylphthalate (the apparent most effective aromatic phlegmatizing agent disclosed in Funk) and triacetin, respectively, run 20 was carried out with triethylene glycol dipelargonate. As shown by comparing the experimental work reported in Table I, the less effective TEGDP was still as effective as the most active prior art aromatic phlegmatizing agent, dibutylphthalate.

In stimulating a well in accordance with the present invention, the explosive formulation is introduced into the well in one or more suitable containers and located adjacent the formation to be treated. As a practical matter, it will be desirable to provide that the explosive formulation is distributed over at least 50% of the hydrocarbon bearing interval to be fractured. Preferably, the explosive formulation is distributed throughout the interval to be fractured.

After the explosive formulation is located adjacent the formation, a stemming or tamping material is placed on top of the explosive. Suitable stemming agents include liquids, e.g., water, or solids such as sand and the like. Because of the practical need to minimize cleanup of the well after the explosive is detonated, it usually will be preferred to fill the well with water to tamp the explosion. For a further description of procedures which may be employed to place and detonate the explosive within the well reference is made to the aforementioned sections of Uren Oil Field Development; pages 588–593 and Oil Field Exploration, pages 165 and 419–424; the entire disclosures in such pages are incorporated herein by reference.

In further experimental work carried respecting the invention, explosive formulations based upon ethylene glycol dinitrate (EGDN) and dibutyoxyethyl adipate (DBEA) were used in the stimulation of actual wells. In each case the formation shot was an oilbearing sandstone at a depth from the surface of the well of about 1000 feet. Two existing wells which had been previously shot were restimulated and two new wells were subject to initial stimulation upon completion. The explosive formulation contained 76% EGDN, 23.5% DBEA and 0.5% ethyl centralite. The formulation was prepared by adding the EGDN to the DBEA under air sparging at a temperature of about 75° F. Ethyl centralite stabilizer was then added to the mixture of the two basic components and the entire mixture agitated under air sparging for about 10 minutes.

The results of the well test procedures are set forth in Table II. In the last two columns of Table II, daily oil production is shown immediately before and two weeks after the stimulation test. As shown for the two existing wells, production, had been for all practical purposes nonexistent, increased to nearly to a barrel per day two weeks after stimulation. The two existing wells at two weeks after stimulation produced substantially more than wells completed in the same area and formation without benefit of liquid explosive fracturing.

TABLE II

| TYPE WELL | PREVIOUSLY SHOT | FEET OF FORMATION | QUARTS USED PER FOOT | QUARTS USED PER SHOT | PRODUCTION PER DAY (GAL) BEFORE | PRODUCTION PER DAY (GAL) AFTER 2 WEEKS |
|---|---|---|---|---|---|---|
| Existing | Yes | 30 | 2 | 60 | 3 | 30 |
| Existing | Yes | 12 | 4.5 | 55 | 1 | 30 |
| New | No | 33 | 3 | 105 | — | 320 |
| New | No | 36 | 3 | 115 | — | 160 |

Having described specific embodiments of the present invention, it will be understood that modification thereof may be suggested to those skilled in the art, and it is intended to cover all such modifications as fall within the scope of the appended claims.

We claim:

1. In the fracturing of a subterranean formation penetrated by a well, the method comprising:

(a) introducing into said well and into proximity to said subterranean formation a liquid explosive composition comprising a nitrate ester explosive component selected from the group consisting of nitroglycerine, ethylene glycol dinitrate, propylene glycol dinitrate, diethylene glycol dinitrate and trimethyl ethylethane trinitrate and mixtures thereof and a phlegmatizer component soluble in said liquid explosive component and having the formula:

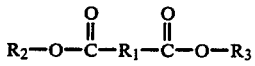

or

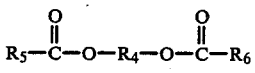

wherein $R_1$ is a $C_4$-$C_9$ alkyl group, $R_2$ and $R_3$ are each independently alkyl or alkoxyalkyl groups containing from 3–11 carbon atoms, $R_4$ is a group, preferably ethyleneglycoxy or polyethyleneglycoxy, containing from 2–6 carbon atoms, and $R_5$ and $R_6$ are each independently alkyl or alkoxyalkyl groups containing from 3–11 carbon atoms, (b) detonating said explosive mixture to fracture said subterranean formation adjacent said well.

2. The method of claim 1 wherein said subterranean formation is a hydrocarbon bearing formation and comprising the subsequent step of placing said well on production to recover hydrocarbons from said formation.

3. The method of claim 1 wherein said explosive composition is distributed along the face of the subterranean formation over at least 50% of said said subterranean formation.

4. The method of claim 1 wherein said phlegmatizing component comprises a compound characterized by the formula:

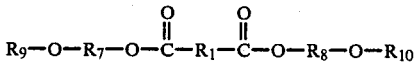

(3)

wherein:

$R_1$ is a $C_4$-$C_9$ alkyl group, $R_7$ and $R_8$ are each independently $—C_2H_4—$ or $—C_3H_6—$ groups, and $R_9$ and $R_{10}$ are each independently alkyl groups containing from 1–6 carbon atoms.

5. The method of claim 1 wherein said phlegmatizer component is present in said explosive composition in an amount within the range of 5–30 wt. %

6. The method of claim 1 wherein said phlegmatizer component is present in said explosive composition in an amount within the range of 7–25 wt. %.

7. The method of claim 1 wherein said phlegmatizer component is present in said explosive composition in a concentration of at least 10 wt. %.

8. The method of claim 1 wherein the concentration of said phlegmatizing agent in said explosive composition is at least 15 wt. %.

9. The method of claim 1 wherein said phlegmatizer component comprises a compound characterized by the formula:

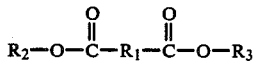

10. The method of claim 9 wherein said phlegmatizer component comprises a diester of adipic acid and wherein $R_2$ and $R_3$ each independently contain from 3–8 carbon atoms.

11. The method of claim 10 wherein $R_2$ and $R_3$ are each independently a methoxyethyl, ethoxyethyl, propoxyethyl, or butoxyethyl group.

12. The method of claim 11 wherein said phlegmatizer component comprises dibutoxyethyl adipate.

13. The method of claim 9 wherein said phlegmatizer component comprises a mixture of dialkyl adipates having an average molecular weight within the range of 360–500.

14. The method of claim 13 wherein said mixture of dialkyl adipates is produced by esterifying adipic acid with a mixture of $C_5$-$C_7$ alkonals.

15. The method of claim 14 wherein the average chain length of $R_2$ and $R_3$ is about 6.5.

16. The method of claim 9 wherein said phlegmatizing agent comprises a diester of azelaic acid.

17. The method of claim 16 wherein $R_2$ and $R_3$ are each independently propyl or butyl groups.

18. The method of claim 9 wherein said phlegmatizing agent is diisobutyl azelate.

19. The method of claim 1 in which said explosive component comprises ethylene glycol dinitrate.

20. The method of claim 1 wherein said explosive component comprises propylene glycol dinitrate.

21. The method of claim 1 wherein said explosive component comprises a mixture of a first constituent selected from the group consisting of ethylene glycol dinitrate, diethylene glycol dinitrate, and trimethylol ethane trinitrate, and nitroglycerin as a second constituent.

22. The method of claim 21 wherein said first explosive constituent comprises at least 50 wt. % of said explosive component.

23. The method of claim 22 wherein said nitroglycerin is present in said explosive component as a minor constituent.

24. The method of claim 23 wherein the weight ratio of said first explosive constituent to said nitroglycerin is within the range of 1.5:1–2:1.

25. The method of claim 1 wherein said explosive composition has a viscosity at minus 20° F. of no more than 500 cp.

26. A liquid explosive composition comprising:

(a) a liquid nitrate ester explosive component selected from the group consisting of nitroglycerine, ethylene glycol dinitrate, propylene glycol dinitrate, diethylene glycol dinitrate and trimethyl ethylethane trinitrate and mixtures thereof, and (b) a phlegmatizer component soluble in said liquid explosive component and having the formula:

$$R_2-O-\overset{O}{\overset{\|}{C}}-R_1-\overset{O}{\overset{\|}{C}}-O-R_3$$

wherein:

$R_1$ is a $C_4$–$C_7$ alkyl group and, $R_2$ and $R_3$ are each independently alkoxy groups containing from 4–9 carbon atoms.

27. The composition of claim 26 wherein said phlegmatize component comprises a compound characterized by the formula $$R_9-O-R_7-O-\overset{O}{\overset{\|}{C}}-R_1-\overset{O}{\overset{\|}{C}}-O-R_8-O-R_{10} \quad (3)$$

wherein:

$R_1$ is a $C_4$–$C_9$ alkyl (1), $R_7$ and $R_8$ are each independently $—C_2H_4—$ or $—C_3H_6—$ groups, and $R_9$ and $R_{10}$ are each independently alkyl groups containing from 1–6 carbon atoms.

28. The composition of claim 26 wherein said explosive composition has a viscosity at minus 20° F. of no more than 500 cp.

29. The composition of claim 26 wherein said phlegmatizer component is present in a concentration of at least 7 wt. %.

30. The composition of claim 27 wherein said phlegmatizer component is present in a concentration of at least 10 wt. %.

31. The composition of claim 26 wherein the concentration of said phlegmatizer component is at least 15 wt. %.

32. The composition of claim 26 wherein said phlegmatizer component comprises a compound wherein $R_2$ and $R_3$ are each independently alkoxyethyl groups.

33. The composition of claim 26 in which said explosive component comprises ethylene glycol dinitrate.

34. The composition of claim 26 wherein said explosive component comprises a mixture of a first major constituent selected from the group consisting of ethylene glycol dinitrate, diethylene glycol dinitrate, and trimethylol ethane trinitrate, and nitroglycerin as a second minor constituent.

35. The composition of claim 34 wherein the weight ratio of said first explosive constituent to said nitroglycerin is within the range of 1.5:1–2:1.

* * * * *

UNITED STATES PATENT AND TRADEMARK OFFICE

CERTIFICATE OF CORRECTION

PATENT NO. : 4,764,231

DATED : August 16, 1988

INVENTOR(S) : Frank E. Slawinski et al.

It is certified that error appears in the above-identified patent and that said Letters Patent is hereby corrected as shown below:

Title page, item [57] ABSTRACT, line 12, change "dibutoxy" to --dibutoxyethyl--.

Col. 4, line 63, change "adipate" to --diester adipate--.

Col. 4, line 68, change "$R^2$ and $R^3$" to --$R_2$ and $R_3$--.

Col. 8, line 68, delete "to", second occurrence.

Col. 11, lines 35-36, change "phlegmatize" to --phlegmatizer".

Signed and Sealed this

Tenth Day of December, 1991

*Attest:*

HARRY F. MANBECK, JR.

*Attesting Officer*

*Commissioner of Patents and Trademarks*